US005402605A

United States Patent [19]

Paules

[11] Patent Number: 5,402,605

[45] Date of Patent: Apr. 4, 1995

[54] OSCILLATING SANDER

[76] Inventor: Eugene Paules, 24 Willard Rd., Shelton, Conn. 06484

[21] Appl. No.: 46,598

[22] Filed: Apr. 12, 1993

[51] Int. Cl.[6] ..... B24B 25/00

[52] U.S. Cl. ..... 451/157; 29/401.1; 451/415

[58] Field of Search ..... 51/35 R, 34 H, 34 K, 51/34 J, 241 R; 29/57, 401.1; 408/20, 25, 27

[56] References Cited

U.S. PATENT DOCUMENTS

| | | | |
|---|---|---|---|
| 2,251,607 | 8/1941 | Astrowski | 51/34 H |
| 2,333,169 | 11/1943 | Glaude . | |
| 2,519,542 | 8/1950 | Carey | 51/34 H |
| 2,930,164 | 3/1960 | Metoff | 51/34 H |
| 3,118,261 | 1/1964 | Glaude | 408/20 |

*Primary Examiner*—Jack W. Lavinder

*Attorney, Agent, or Firm*—William J. Spatz; Fred A. Keire

[57] ABSTRACT

An assembly for converting a conventional drill press into an oscillating spindle sander is disclosed. The oscillating spindle sander assembly is comprised of an auxiliary motor which is adapted to be mounted on a drill press. An eccentric drive is attached to the rotating shaft of the auxiliary motor and is used to drive a push rod in a lateral reciprocating motion. The opposite end of the push rod is attached to one of the spindle spokes of the drill press, and causes it to move in a radially reciprocating motion which induces the drill press spindle, drill chuck and a sanding tool mounted therein, to move up and down in an oscillating motion. The oscillating spindle sander assembly of the invention can be easily disabled and the converted drill press returned to normal operation by removing the push rod from the spindle spoke of the drill press.

14 Claims, 2 Drawing Sheets

OSCILLATING SANDER

BACKGROUND OF THE INVENTION

The present invention relates to oscillating spindle sanding, and more particularly, to an assembly which enables a conventional drill press to be converted to an oscillating spindle sander.

It is a well known practice in woodworking to sand concave wooden surfaces using a sanding drum mounted on a drill press. Skilled woodworkers recognize that sanding done in this fashion often produces small grooves or scratches on the sanded surface but many nevertheless have suffered this inconvenience because oscillating spindle sanders, which avoid the problem, have heretofore been too specialized and expensive to find their way into most workshops. Consequently, it has been commonplace for work pieces which have been sanded by means of a drum sander mounted in a conventional drill press to require extensive hand finishing to remove grooves and scratches from their sanded surfaces.

SUMMARY OF THE INVENTION

The present invention is directed to an assembly which can be used to convert a conventional drill press into an oscillating spindle sander. The oscillating sander assembly of the invention is easy to install, and, once installed, can be readily disabled so as to return the converted drill press to normal operation.

In accordance with the present invention, an auxiliary gear motor is mounted on a conventional drill press and adapted to drive a push rod in a reciprocating lateral motion by means of an eccentric mounted on the shaft of the motor. The opposite end of the push rod is affixed to one of the spindle feed spokes of the drill press, and causes the spindle feed spoke to move radially back and forth. This motion of the spindle feed spoke causes the drill press spindle, drill chuck and mounted drum sander to oscillate vertically. A drill press so equipped can easily and rapidly be returned to normal operation simply by disconnecting the push rod from the drive spoke of the drill press.

The oscillating spindle sander assembly of the present invention is provided in kit form to enable the ready conversion of many different commercially available drill presses into oscillating spindle sanders. In as much as there are numerous different types and models of drill press, the conversion kit according to the present invention is designed to accommodate a variety of drill press designs.

The above and other objects of the present invention are achieved with an oscillating spindle sander conversion kit wherein the aforedescribed auxiliary motor is mounted on the spindle side of the drill press, using a mounting bracket which has pre-drilled holes corresponding to the placement of bolts or screws in the housing of the drill press to be modified. The screws or bolts in drill press housing are removed and the motor mounting bracket is attached to the drill press by inserting bolts or other fasteners through the bracket into the now empty bolt or screw holes in drill press housing. Where necessary for flush mounting, washers or shims are inserted between the bracket and the drill press housing. In a preferred embodiment of the invention, the motor mounting bracket is equipped with slotted mounting holes which correspond to the positions of bolts or screws in the housings of different drill press models. In this way, the same conversion kit can be used on a variety of different drill presses. Of course, it is also possible for the user to mount the motor bracket to his drill press by applying his own fasteners, if the mounting bracket does not have mounting holes which correspond to his particular drill press.

The auxiliary motor is attached to the drill press mounting bracket on a frame, from which the motor shaft projects in a direction essentially perpendicular to the plane of the drill press spindle spokes.

The eccentric drive is attached to shaft of motor with a set screw. The eccentric drive has at least one mounting hole, for attaching the push rod. The push rod mounting hole is spaced from the motor drive shaft by a distance selected to provide the push rod with the desired degree of lateral movement. To determine where the push rod mounting hole should be located on the eccentric drive, it must first be determined how far the drill press spindle spoke must move to provide the desired amount of oscillation at a sanding drum mounted in the drill press. The amount of oscillation desired at the drum sander depends in part on the size of the work piece to be sanded. Since sanding drums which are 2 or 3 inches in height are suitable for most applications, they are a good standard upon which to base system setup and I have found that $\frac{1}{2}$ inch of oscillation provides excellent results with them. One half inch of oscillation also provides excellent results with all other sizes of sanding drums except for miniature drums of $\frac{1}{4}$ to $\frac{1}{2}$ inch in height. For sanding drums in this size range, $\frac{1}{8}$ inch of oscillation is preferred. In many drill press models, $\frac{1}{2}$ inch of oscillation at the drill chuck translates into approximately 60° of arc swing at the drill press spindle spoke hub. To achieve 60° of arc swing in the spindle spokes, the push rod is attached to one of the spindle spokes at a point between approximately 2 and 3 inches from the spoke hub. At this point, 60° of arc swing translates into approximately $1\frac{3}{4}$ inches of lateral movement. To achieve $1\frac{3}{4}$ inches of lateral movement in the push rod, the motor end of the push rod is affixed to the eccentric drive at a point approximately $\frac{7}{8}$ of an inch from the motor shaft. In this way, one revolution of the eccentric drive produces $1\frac{3}{4}$ inches of lateral movement in the push rod and approximate 60° of rotation in the drill press spindle spokes.

The oscillating sander assembly of the present invention can be easily adjusted to provide for greater or lesser oscillatory motion at the sanding drum or to accommodate differences in drill press design by changing where the push rod is attached to the spindle spoke. If the point of attachment is moved axially inward on a spindle spoke, a given amount of lateral movement provided by the eccentric drive will translate into a greater arc swing in the spindle spokes and a larger oscillatory motion in the sanding drum. Conversely, if the arc swing provided exceeds the desired amount, it can be decreased by moving the push rod's point of attachment on the spindle spoke axially outward along the spoke. By moving the point of attachment to the outward end of the spoke, a stroke of about $\frac{1}{8}$ inch is achieved, which is very desirable for miniature sanding drums frequently used on thin, intricate work. The oscillating spindle sander assembly of the present invention can thus accommodate a wide variety of drill presses simply by the selective placement of the clamp bracket used to link the push rod to the drive spindle spoke. Further, even greater flexibility can be provided by providing several mounting holes on the eccentric drive which are at varying distances from the motor shaft. For example, if the push rod is pivotally mounted on the eccentric at a point which is ½ inch from the rotational center of the eccentric, this will produce a lateral reciprocation motion in the push rod and spindle spoke of 1 inch, whereas if the push rod is pivotally mounted to the eccentric drive at a point 1 ½ inches from the rotational center of the eccentric, this will yield a lateral reciprocation motion of 3 inches.

To provide maximum thrust, the length of the push rod in the oscillating spindle sander of the invention is selected so that the mid-swing position for the drive spindle is as close as possible to 6 o'clock. Further, as indicated above, the best results are achieved when the radial arc traversed by the drive spoke is about 60° however satisfactory results are achieved with swing arcs of up to 90°. Generally, swing arcs of over 90° are to be avoided.

The oscillating spindle sander kit of the invention can incorporate push rods of several different sizes to accommodate a variety of drill press models, or, a single push rod of adequate length for any installation which is cut to the appropriate length for drill press installations requiring a shorter push rod. In another embodiment of the invention, the push rod can be composed of two threaded sections and a central toggle sleeve, whereby the length of the push rod can be increased or decreased by twisting the toggle sleeve.

It has been found that in certain drill press models, the spindle spokes provided by the drill press manufacturer do not lend themselves to the application of a spoke clamp bracket. For drill presses in this group, and to facilitate the spoke clamp bracket being rigidly affixed to the drive spoke with an orientation which is at a right angle to the plane traversed by the drill press spindle spokes, the kit of the present invention includes a substitute spoke having a shape which is complementary to the spoke clamp bracket. In another preferred embodiment of the invention, the substitute drive spoke is composed of two sections so that the axially outer section of the spoke can be removed in the event that it projects into an area which interferes with a work piece being sanded.

BRIEF DESCRIPTION OF THE DRAWING

The invention, as well as its objects and features, will be better understood by reference to the following detailed description of the preferred embodiments of this invention, in conjunction with the accompanying drawings, which are incorporated in, and form a part of, this specification. In the drawings.

DETAILED DESCRIPTION OF THE INVENTION

Figure 1:
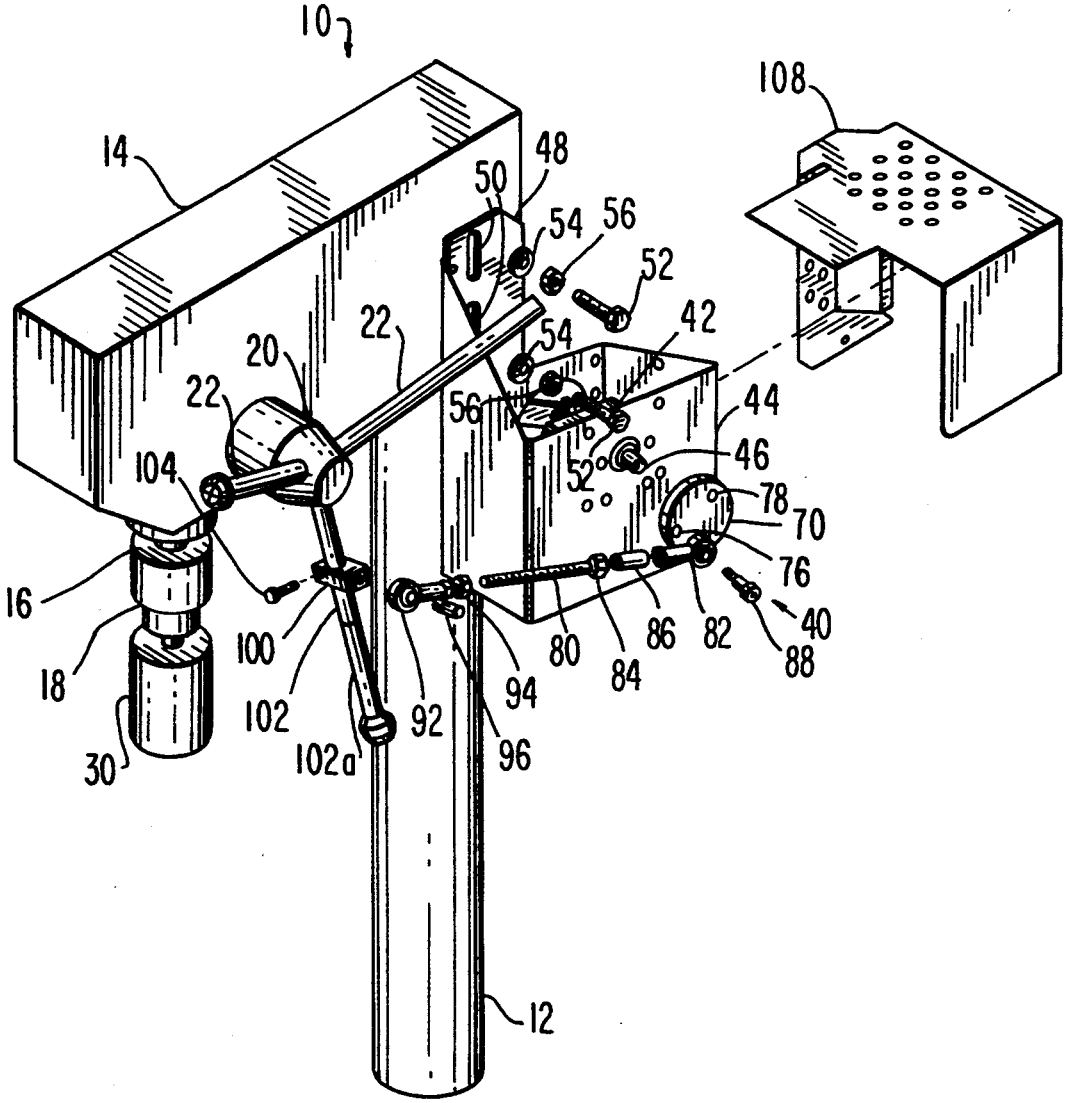
FIG. 1 is an exploded perspective view of a drill press incorporating the oscillating spindle sander assembly according to the present invention.
Figure 2:
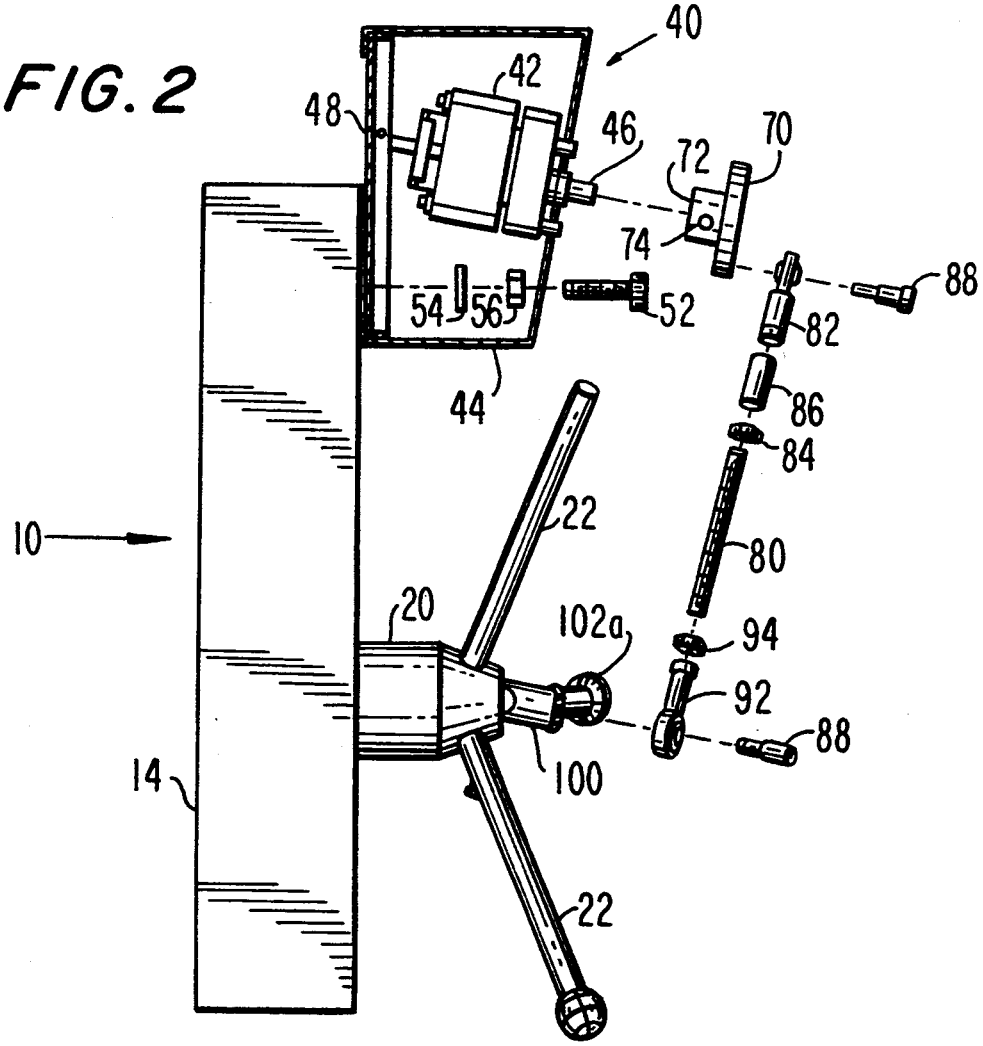
FIG. 2 is an exploded top view of a drill press incorporating the oscillating spindle sander assembly according to the present invention.

A drill press incorporating the oscillating spindle sander assembly according to the present invention is shown in FIG. 1. Drill press 10 is illustrated in simplified form. Drill press 10 consists of column 12, drill press housing 14, spindle 16, drill chuck 18, spindle spoke hub 20 and spindle spokes 22. Drill press 10 is equipped with sanding drum 30.

Oscillating spindle sander assembly 40 includes an electric motor 42 which is attached to mounting frame 44 with motor shaft 46 projecting therethrough in a direction perpendicular to the plane traversed by spindle spokes 22. Mounting frame 44 is bolted or screwed to mounting bracket 48 with fasteners which are not shown in the drawing. Mounting bracket 48 incorporates pre-drilled mounting holes 50 which are positioned on mounting bracket 48 so as to align with bolts in a selected drill press housing. During installation, the selected set screws are removed from drill press housing 14 and mounting bracket 48 is fastened to housing 14 at the empty bolt holes using bolts 52, washers 54 and lock nuts 56.

Electric motor 42 is a geared motor providing about 50 to about 90, and preferably about 70, revolutions per minute at motor shaft 46. For continuous duty applications, motor 42 will generally be of an air cooled design, but in other applications where continuous duty cycles are not required, motor 42 can be of a cheaper design incorporating thermal protection. Although not shown in the drawings, an on/off switch for motor 42 and a grommet to secure the power supply cord used to energize motor 42, through the on/off switch are located on the rear of mounting frame 44.

Slotted mounting holes 50 in mounting bracket 48 are positioned to align with bolts on the housing of most woodworking drill press models in current manufacture. Additional mounting holes in different positions can also be provided for use when assembly 40 is mounted on different drill press models. Alternatively, to facilitate installation, assembly 40 can include two or more different mounting brackets 48 with each such mounting bracket being adapted for installation on selected drill press models. In such case, motor mounting frame 44 would be fastened to the appropriate mounting bracket using fasteners (not shown) either before or after the appropriate mounting bracket 48 is affixed to drill press housing 14.

Eccentric drive 70 is mounted on motor shaft 46 by inserting shaft 46 into central bore 72 and fastening with set screw 74. Eccentric drive 70 contains push rod mounting holes 76 and 78. Mounting hole 78 is positioned relatively close to central bore 72 for installations where only moderate radial movement of spindle spokes 22 is necessary to achieve the desired amount of oscillation at sanding drum 30. Mounting hole 76 is positioned on eccentric drive 70 relatively further from central bore 72, for use in installations where oscillating sander assembly 40 must provide greater radial movement of spindle spokes 22. In the depicted embodiment of the invention, only mounting hole 76 is utilized.

Assembly 40 includes motor guard 108 which is adapted to fit over mounting frame 44 and eccentric drive 70 for safety reasons.

In the oscillating spindle sander assembly 40 of the invention, rotational movement at motor shaft 46 is converted into reciprocating lateral movement of push rod 80 with eccentric drive 70. Threaded push rod 80 is connected to eccentric drive 70 by means of rod end bearing 82. Push rod 80 and rod end bearing 82 are secured with lock nut 84. To ensure that lock nut 84 does not interfere with eccentric drive 70, spacer tube 86 is placed over threaded push rod 80 adjacent to rod end bearing 82 before push rod 80 is threaded into rod end bearing 82 and secured with lock nut 84. Rod end bearing 82 is then secured to eccentric drive 70 at mounting hole 76 using stripper bolt 88. In a similar fashion, duplicate rod end bearing 92 is threaded on to the opposite end of push rod 80 and secured thereto using lock nut 94. To enable the lateral motion of push rod 80 to be conveyed to the spindle spoke hub 20, spoke clamp bracket 100 is applied to drive spoke 102, and secured in position with retaining bolt 104. Push rod 80 is removably attached to spoke clamp bracket 100 with headless stripper bolt 96, which permits push rod 80 to be attached to and removed from spoke clamp bracket 100 without tools. In the depicted embodiment of the invention, drive spoke 102 is a substitute spoke provided with oscillating spindle sander assembly 40. Drive spoke 102 is shorter in length than spindle spokes 22 so that it does not interfere with large work pieces when they are sanded using oscillating spindle sander assembly 40. When drill press 10 is returned to normal operation by detaching rod end bearing 92 from spoke clamp bracket 100, drive spoke 102 is extended to the same length as spindle spokes 22 with spoke extension rod 102*a*.

In the preferred embodiment of the invention, the length of push rod 80 is selected so that drive spoke 102 is at the 6 o'clock position when mounting hole 76 on the eccentric drive 70 is at either the 6 o'clock or 12 o'clock position with respect to motor shaft 46. Since it is contemplated that a kit will be provided to convert several different models of drill press into oscillating spindle sanders, in one embodiment of the invention, threaded push rod 80 is supplied in a length which is sufficient for all drill press models upon which assembly 40 might be installed. In such case, push rod 80 is cut to the appropriate length for each installation. In other embodiments of the invention, push rod 80 is supplied in several different lengths or is replaced with adjustable push rod 110.

Figure 3:
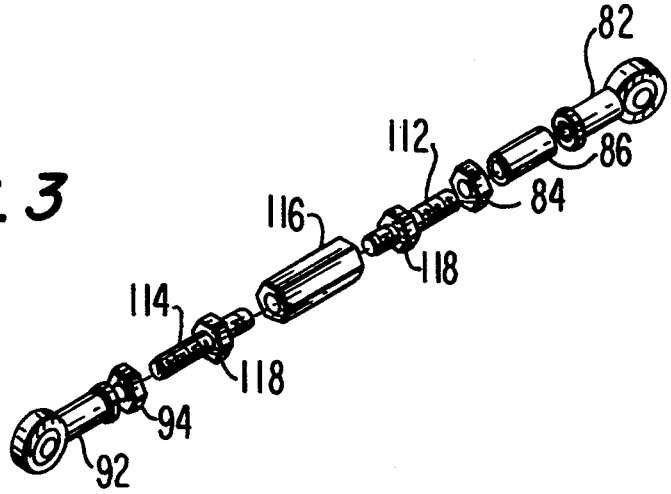
FIG. 3 is an exploded perspective view of an adjustable push rod which is used in one embodiment of the invention.

As shown in FIG. 3, adjustable push rod 110 is composed of right rod end 112 and left rod end 114. Rod ends 112 and 114 are connected by toggle sleeve 116. Twisting toggle sleeve 116 in one direction causes adjustable push rod 110 to be lengthened, and twisting it in the opposite direction causes adjustable push rod 110 to be shortened. When adjustable push rod 110 is used, oscillating spindle sander assembly 40 can be installed and critically adjusted in place. After push rod 110 is adjusted to the desired length, toggle sleeve 116 is fixed in place with lock nuts 118.

After oscillating spindle sander assembly 40 is installed on drill press 10 as aforedescribed, the amount of oscillation at sanding drum 30 can be readily adjusted by changing the position of spoke clamp bracket 100 on drive spoke 102. If spoke clamp bracket 100 is moved closer to spindle spoke hub 20, the amount of oscillation at sanding drum 30 will be increased and, conversely, if spoke clamp bracket 100 is moved to a position slightly more distant from spindle spoke hub 20, the amount of oscillation experienced at sanding drum 30 will be decreased.

Although specific embodiments of the invention have been illustrated and described, it will be obvious to those skilled in the art that various modifications may be made without departing from the spirit of the invention, which is intended to be limited solely by the appending claims.

I claim:

1. An oscillating spindle drill press kit having component parts capable of being installed on a conventional drill press comprised of a drill press housing, a movable spindle operatively mounted on said drill press housing, a motor for rotating the spindle, a drill chuck for holding tools affixed to said spindle, and at least one spindle spoke mounted on a spoke hub which is adapted to raise and lower said spindle when said spindle spoke is moved in a radial direction, the kit comprising:

a drive motor having a rotating output shaft;

means for mounting said drive motor on said drill press housing;

rotary motion conversion means for converting the rotary motion of the output shaft of said drive motor into lateral reciprocating motion in a push rod means, said rotary motion conversion means being adapted to be mounted on the output shaft of said drive motor and said push rod means being adapted to be mounted on said rotary motion conversion means, a spoke clamp bracket adapted to be affixed to a spindle spoke on said drill press, said spoke clamp bracket having a removable push rod connector means for rotatably linking said push rod means to said spindle spoke, whereby when said spindle spoke is linked to said push rod means it is induced to move in a radially reciprocating fashion as said push rod means moves in said lateral reciprocating motion, and said drill press spindle is thereby caused to oscillate.

2. The oscillating spindle drill press kit of claim 1, further comprising a sanding drum in said drill chuck.

3. The oscillating spindle drill press kit of claim 1, wherein said rotary motion conversion means is an eccentric drive.

4. The oscillating spindle drill press kit of claim 3, wherein said push rod means is a rigid rod having a bearing ring on the end thereof which is adapted to be mounted on said eccentric drive.

5. The oscillating spindle drill press kit of claim 3, wherein said push rod means is an adjustable rod comprised of two threaded rods coupled by a toggle linkage.

6. The oscillating spindle drill press kit of claim 2, wherein said rotary motion conversion means is an eccentric drive.

7. The oscillating spindle drill press kit of claim 6, wherein said push rod means is a rigid rod having a bearing ring on the end thereof which is adapted to be mounted on said eccentric drive.

8. An oscillating spindle drill press comprising:

a drill press housing;

a movable spindle extending downwardly from said drill press housing a motor for rotating the spindle;

a drive means operating to raise and lower said movable spindle, said drive means including a spindle hub mounted on said drill press housing and at least one spindle spoke extending axially from said spindle hub and being operatively connected to said drive means to raise said spindle when said spindle spoke is moved radially in a first direction and to lower said spindle when said spindle spoke is moved radially in the opposite direction;

a drill chuck affixed to said spindle for holding tools;

a drive motor mounted on said drill press housing, said drive motor having a rotating output shaft;

a rotary motion conversion means mounted on the output shaft of said drive motor for converting the rotary motion of said output shaft into lateral reciprocating motion;

a push rod means connected to said rotary motion conversion means, and being moved thereby in a lateral reciprocating motion;

a spoke clamp bracket affixed to a spindle spoke on said drill press, and said push rod means being removably connected to said spoke clamp bracket and conveying the lateral reciprocating motion of said push rod means to said spindle spoke, whereby said spindle spoke is caused to move in a radially reciprocating motion when said push rod means moves in said laterally reciprocating motion and said drill press spindle is thereby caused to oscillate.

9. The oscillating spindle drill press of claim 8, further comprising a sanding drum in said drill chuck.

10. The oscillating spindle drill press of claim 8, wherein said rotary motion conversion means is an eccentric drive.

11. The oscillating spindle drill press of claim 10, wherein said push rod means is a rigid rod having a bearing ring on the end thereof which is connected to said eccentric drive.

12. The oscillating spindle drill press of claim 10, wherein said push rod means is an adjustable rod comprised of two threaded rods coupled by a toggle linkage.

13. The oscillating spindle drill press of claim 9, wherein said rotary motion conversion means is an eccentric drive.

14. The oscillating spindle drill press of claim 13, wherein said push rod means is a rigid rod having a bearing ring on the end thereof which is connected to said eccentric drive.

* * * * *